US010920788B2

(12) United States Patent
Scotti Del Greco et al.

(10) Patent No.: US 10,920,788 B2
(45) Date of Patent: Feb. 16, 2021

(54) LIQUID TOLERANT IMPELLER FOR CENTRIFUGAL COMPRESSORS

(71) Applicant: Nuovo Pignone Srl, Florence (IT)

(72) Inventors: Alberto Scotti Del Greco, Florence (IT); Andrea Arnone, Florence (IT); Matteo Checcucci, Florence (IT); Filippo Rubechini, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 354 days.

(21) Appl. No.: 15/021,154

(22) PCT Filed: Sep. 11, 2014

(86) PCT No.: PCT/EP2014/069422
§ 371 (c)(1),
(2) Date: Mar. 10, 2016

(87) PCT Pub. No.: WO2015/036497
PCT Pub. Date: Mar. 19, 2015

(65) Prior Publication Data

US 2016/0222980 A1 Aug. 4, 2016

(30) Foreign Application Priority Data

Sep. 12, 2013 (IT) ..... CO2013A000037

(51) Int. Cl.
*F04D 29/28* (2006.01)
*F04D 29/44* (2006.01)
(Continued)

(52) U.S. Cl.
CPC ..... *F04D 29/441* (2013.01); *F04D 17/12* (2013.01); *F04D 17/122* (2013.01);
(Continued)

(58) Field of Classification Search
CPC .... F04D 17/122; F04D 29/242; F04D 29/284; F04D 29/286; F04D 29/289; F04D 29/30; F05D 2240/303
See application file for complete search history.

(56) References Cited

U.S. PATENT DOCUMENTS 1,250,681 A 12/1917 Sheldon
3,536,416 A 10/1970 Glucksman
(Continued)

FOREIGN PATENT DOCUMENTS

CN 102459915 A 5/2012
CN 203067350 U 7/2013
(Continued)

OTHER PUBLICATIONS

Machine Translation and Second Office Action and Supplementary Search issued in connection with corresponding CN Application No. 201480050315.5 dated Dec. 1, 2017.
(Continued)

*Primary Examiner* — Ninh H. Nguyen
(74) *Attorney, Agent, or Firm* — Baker Hughes Patent Org.

(57) ABSTRACT

In order to reduce erosion of an impeller due to liquid droplets in an incoming flow of gas, the impeller comprises converging-diverging bottlenecks; the incoming flow passes through the bottlenecks so that the speed of the gas at the inlet of the impeller first suddenly and substantially increases and then suddenly and substantially decreases; furthermore, the impeller is configured so that, internally after its inlet, the incoming flow is deviated gradually in the meridional plane.

16 Claims, 6 Drawing Sheets

(51) Int. Cl.
*F04D 29/24* (2006.01)
*F04D 17/12* (2006.01)
*F04D 29/30* (2006.01)

(52) U.S. Cl.
CPC ..... *F04D 29/242* (2013.01); *F04D 29/284* (2013.01); *F04D 29/286* (2013.01); *F04D 29/289* (2013.01); *F04D 29/30* (2013.01); *F05D 2240/303* (2013.01)

(56) References Cited

U.S. PATENT DOCUMENTS 4,224,010 A * 9/1980 Fujino ..... F04D 17/122 415/199.2
5,064,346 A * 11/1991 Atarashi ..... F01D 5/141 416/178
5,228,832 A 7/1993 Nishida
5,800,128 A * 9/1998 Bodmer ..... F04D 29/023 416/183
6,340,287 B1 * 1/2002 Eino ..... F04D 29/2222 415/199.1
9,404,506 B2 * 8/2016 Masutani ..... F04D 29/30
2006/0067829 A1 3/2006 Vrbas et al.
2007/0077147 A1 4/2007 Higashimori et al.
2009/0129933 A1 5/2009 Kilian et al.
2012/0027599 A1 * 2/2012 Masutani ..... F04D 29/286 416/198 R
2012/0224952 A1 9/2012 Hofer et al.

FOREIGN PATENT DOCUMENTS

JP H03264796 A 11/1995
JP H09296799 A 11/1997
JP H10148133 A 6/1998
RU 2 187 714 C2 8/2002
RU 2 449 179 C1 4/2012

OTHER PUBLICATIONS

Unofficial English Translation of Chinese Office Action issued in connection with corresponding CN Application No. 201480050315.5 dated Mar. 27, 2017.
International Search Reprt and Written Opinion dated Nov. 4, 2014 which was issued in connection with PCT Patent Application No. PCT/EP2014/069422 which was filed on Sep. 11, 2014.
Italian Search Report and Written Opinion dated Jun. 4, 2014 which was issued in connection with Italian Patent Application No. CO2013A000037 which was filed on Sep. 12, 2013.
Decision to Grant issued in connection with corresponding RU Application No. 2016107756 dated Jan. 10, 2019.

* cited by examiner

LIQUID TOLERANT IMPELLER FOR CENTRIFUGAL COMPRESSORS

BACKGROUND

Embodiments of the subject matter disclosed herein relate to impellers for rotary machines, methods for reducing erosion of impellers, and centrifugal compressors.

There are many solutions wherein an impeller is designed to receive a gas flow at its inlet. In such solutions, it is quite common that during most of the operating time of the impeller the gas is perfectly dry and in some situations the gas contains some liquid; the liquid may be in the form of droplets inside the gas flow. In such situations, the liquid droplets hit against the impeller, in particular the surfaces of the internal passages of the impeller; this means that the liquid droplets may erode the impeller. In the case of impellers used in centrifugal compressors, erosion affects the blade surfaces and, even more, the hub surface.

It is to be noted that the effect of droplets collisions is not linear. Initially, droplets collisions with the surfaces of the impeller passages seem to have no effect and they cause no erosion on the surfaces; after a number of collisions, the effect becomes apparent and the surfaces rapidly deteriorate. The erosion time threshold depends on various factors including e.g. the mass and size of the droplets as well as the speed of the droplets, in particular the component of the speed normal to the surface hit by the droplets.

It is to be noted that impellers should be used e.g. in compressors when impellers damages due to surface deterioration are negligible or absent at all; otherwise, impellers should be repaired or replaced.

It is also to be noticed that impellers damages due to surface deterioration are not easy to be detected as soon as the deterioration starts if the rotary machine is operative and the impeller is rotating; deterioration is often detected only when it is very severe and is causing vibrations.

Therefore, there is a need for a method of reducing erosion of impellers due to liquid droplets in an incoming flow of gas. This need exists in particular for the impellers of centrifugal compressors.

By reducing erosion, the lifetime of impellers will be increased and consequently also the uptime of the rotary machines will be increased.

SUMMARY OF THE INVENTION

The solution should take into account that during most of the operating time the incoming gas flow contains no liquid droplets; therefore, the operation in dry conditions should not be excessively penalized by any measure taken for reducing erosion.

According to some embodiments, there is a closed impeller for a rotary machine having an inlet, an outlet and a plurality of passages fluidly connecting the inlet to the outlet; each of the passages are defined by a hub, a shroud and two blades; at the inlet the thickness of the blades first increases and then decreases so to create a converging-diverging bottlenecks in the passages localized at the inlet zone of the passages. Each blade having an upstream portion wherein the thickness first suddenly increases and then decreases and a downstream portion having a substantially constant thickness.

According to other embodiments, there is a method for reducing erosion of an impeller due to liquid droplets in an incoming flow of gas; the incoming flow passes through a converging-diverging bottleneck so to first increase and then decrease the speed of the gas at an inlet of the impeller. More particularly, after the inlet of the impeller and inside the impeller, the incoming flow is deviated gradually in the meridional plane.

According to other embodiments, there is a centrifugal compressor having a plurality of compressor stages; the compressor is tolerant to liquid at its inlet; at least the first stage comprises an impeller wherein at the inlet the thickness of the blades first increases and then decreases so to create a converging-diverging bottlenecks in the internal passages of the impeller.

The present invention will become more apparent from the following description of exemplary embodiments to be considered in conjunction with accompanying drawings wherein:

DETAILED DESCRIPTION

The following description of exemplary embodiments refers to the accompanying drawings. The same reference numbers in different drawings identify the same or similar elements. The following detailed description does not limit embodiments of the present invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
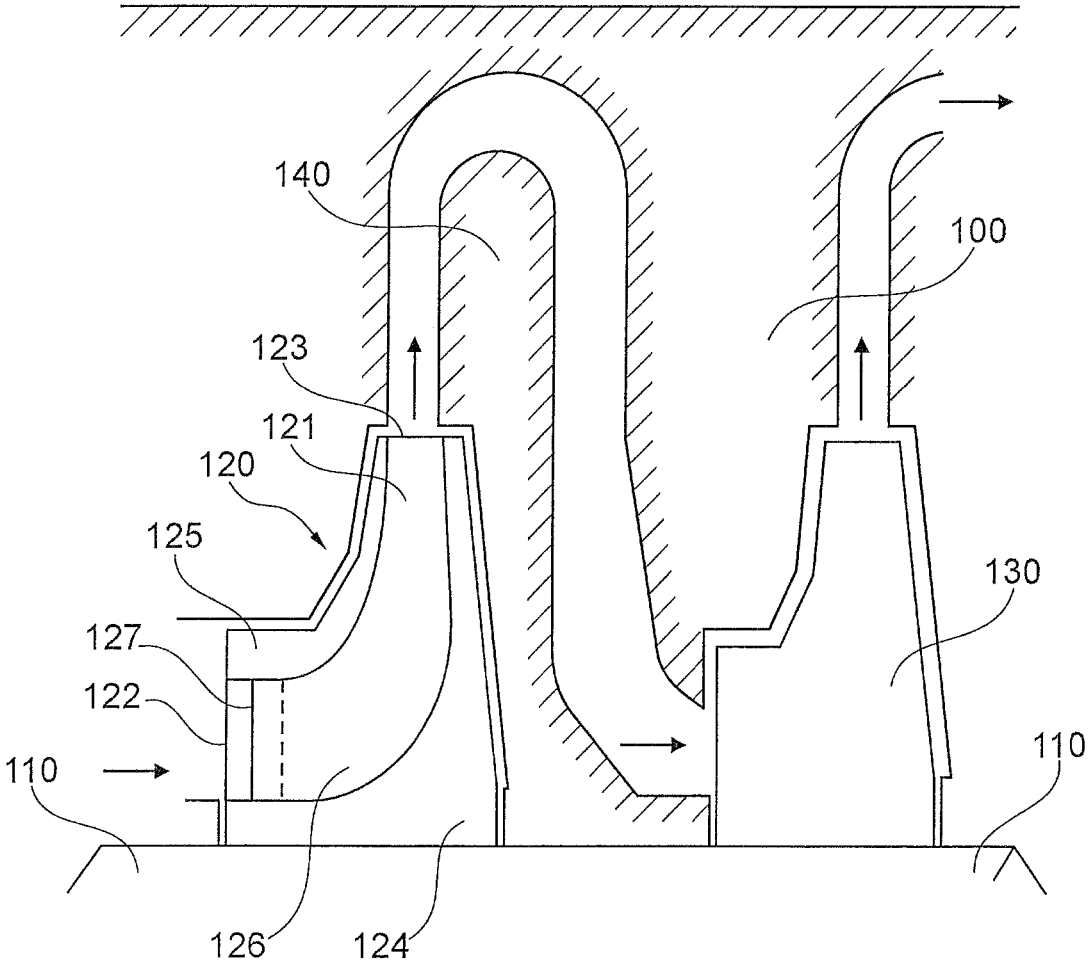
FIG. 1 shows a very schematic view of a multi-stage centrifugal compressor.

FIG. 1 shows two stages of a centrifugal compressor and the two corresponding impellers 120 and 130; specifically, impeller 120 is the first impeller (first stage) that is the first one receiving the incoming gas flow, and impeller 130 is the second impeller (second stage) that is the second one receiving the incoming gas flow just after the first impeller 120. The compressor essentially consists of a rotor and a stator 100 and a rotor; the rotor comprises a shaft 110, the impellers 120 and 130 fixed to the shaft 110, and diffusers 140 fixed to the shaft 110.

FIG. 1 shows the first impeller 120 in cross-section view and the second impeller 130 in outside view.

With regard to the first impeller 120, FIG. 1 shows one of its internal passages 121 fluidly connecting the inlet 122 of the impeller to the outlet 123 of the impeller; passage 121 is defined by a hub 124, a shroud 125 and two blades 126 (only one of which is shown in FIG. 1). The inlet and outlet zones of the impeller extend a bit inside the impeller; in particular, the inlet zone of the impeller corresponds to the inlet zones of the internal passages (see dashed line in FIG. 1) even if the leading edges 127 of the blades 126 may be set back from the front side of the impeller (see FIG. 1). As it will become more apparent from the following, it is beneficial that the whole inlet zones of the impeller passages lie in the inlet zone of the impeller as, in this way, the action of the converging-diverging bottlenecks associated with the passages inlet zones (in particular with the blades) occurs just at the beginning of the passages.

During most of the operating time of the impeller 120 the gas of the incoming flow is perfectly dry and in some situations the gas contains some liquid in the form of droplets. In such situations, the liquid droplets hit against the impeller, in particular the surfaces of the internal passages 121 of the impeller, more in particular the surface of the hub 124.

A first measure for reducing the erosion by the droplets is to reduce the mass and size of the droplets; such reduction is effective if it is carried out at the inlet zone of the impeller, more particularly at the inlet zone of the internal passages of the impeller.

Figure 2A:
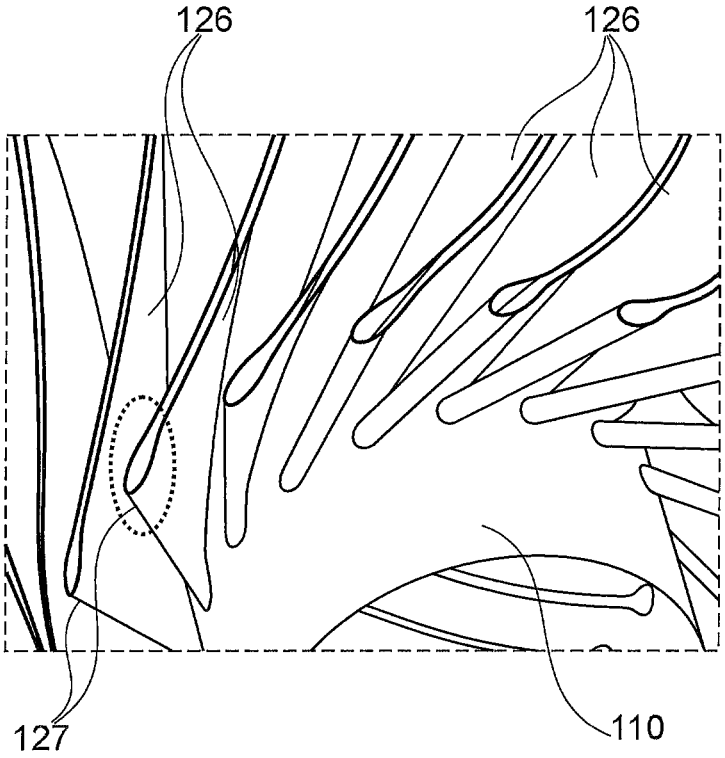
FIG. 2A shows a partial tridimensional view of an impeller according to an embodiment.
Figure 2B:
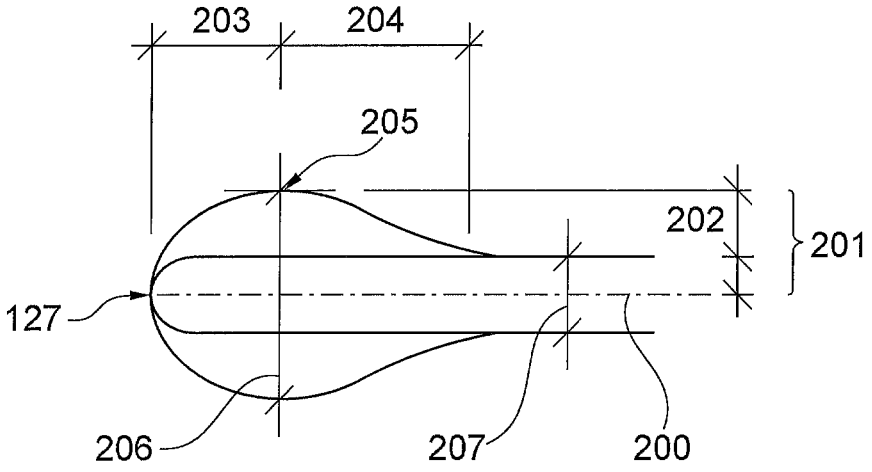
FIG. 2B shows a detail of the impeller of FIG. 2A.

In the embodiment of FIG. 2, the thickness of each blade is first suddenly and substantially increased (see e.g. FIG. 2B on the left) and then suddenly and substantially decreased (see e.g. FIG. 2B on the right); considering that the blades of the impellers face each other (see e.g. FIG. 2A), the thickness increase and thickness decrease creates a converging-diverging bottleneck in the passages localized in the inlet zone of the passage. Due to such bottleneck, the liquid droplets undergo a break-up process, i.e. they are forcedly broken by the relative gas flow. This takes place because of the different inertia between liquid and gas. Both the thickness increase and the consequent gas acceleration and the thickness decrease and the consequent gas deceleration increase the relative velocity between the two phases (i.e. gas and liquid) because droplets are almost insensitive to gas velocity variations, especially if they are sudden and substantial, and tend to proceed at constant velocity.

The break-up process is enhanced by the different inertia of the two phases; however, when the density of the liquid of the droplets exceeds that of gas by more than 50 times, the droplets approach the impeller with a highly tangential relative velocity (since the meridional velocity is much smaller for droplets than for gas) and they hit against the pressure side of blades. In these conditions, the break-up process as described above may become less effective or totally useless.

Typically but not necessarily, all the internal passages of the impeller are provided with such kind of bottlenecks and all the blades of the impeller are configured with such kind of initial thickness increase and thickness decrease; typically but not necessarily, all the blades will be identical.

FIG. 2A shows the cross-section of the initial part of one blade according to the embodiment (drop shaped) as well as the one according to the prior art (substantially flat); the sectional plane of FIG. 2B is horizontal and perpendicular to the plane of FIG. 1 and the detail of FIG. 2B can be found between the vertical solid line 127 (leading edge of the blade) and the dashed line parallel to it.

The upstream portion of the blade is localized at the beginning of the blade itself, according to the flow sense. In particular, as FIG. 2A shows, the upstream portion length is less than 20% of the camber line length, being the camber line a line on a cross section of the passage which is equidistant from the hub and shroud surfaces.

In FIG. 2B the thickness decrease immediately follows the thickness increase; this means that between them there is not part of the blade having a constant thickness; in this way, the gas velocity is continually forced to change in the bottleneck zone and the droplets are highly disturbed.

In the embodiment of FIG. 2, the cross-section of the blade is symmetric with respect to the camber line 200 and the thickness increase and the thickness decrease are identically distributed on both sides of the blade. Anyway, according to alternative embodiments, the cross-section of the blade may be asymmetric with respect to the camber line 200, and the thickness increase and/or the thickness decrease may be asymmetrically distributed and even only on one side of the blade. To this regard, it is to be noticed that, considering the flow direction at the inlet of the impeller passages (see e.g. FIG. 2A), the leading edge of a blade often faces a flat area of the adjacent blade; therefore, the positioning of the thickness increases and of the thickness decreases might also take this misalignment into account.

In the embodiment of FIG. 2, the thickness increase amount, corresponding to twice the length 201, is different from the thickness decrease amount, corresponding to twice the length 202, as the thickness increase starts just on the leading edge 127 of the blade. Anyway, if, for example, the thickness increase starts at a distance from the edge, the two amounts may be equal.

The thickness increase rate, corresponding in FIG. 2B to the ratio between the length 201 and the length 203, may be equal to or different from the thickness decrease rate, corresponding in FIG. 2B to the ratio between the length 202 and the length 204; in the embodiment according to FIG. 2, they are different: the increase rate is a bit higher than the decrease rate.

It is beneficial that the thickness increase and the thickness decrease are gradual in order to avoid or at least limit turbulence in the gas flow due to the thickness increase and the thickness decrease.

In general the maximum, 205 in FIG. 2B, of the blade is distant from the leading edge of the blade, 127 in FIG. 2B; for example, it is distant between 25% and 75% of the distance of the end of the thickness decrease, corresponding in FIG. 2B to the sum of lengths 203 and 204.

The thickness decrease may be, for example, at least 50% (with respect to the thickness before the start of the decrease); in other words and with reference to FIG. 2B, length 202 is bigger than or equal to 50% of length 201 or equivalently length 207 is smaller than or equal to 50% of length 206.

The thickness decrease ends at a distance from the leading edge of the blade, 127 in FIG. 2B; for example, this distance, corresponding in FIG. 2B to the sum of lengths 203 and 204, may be more than 2 and less than 6 times the maximum thickness of the blade (before the thickness decrease), corresponding in FIG. 2B to the length 206.

Contrary to the embodiment of FIG. 2, the thickness increase may start at a distance from the leading edge of the blade; for example, this distance may be more than 1 and less than 4 times the maximum thickness of the blade (before the thickness decrease), corresponding in FIG. 2B to the length 206.

Figure 3:
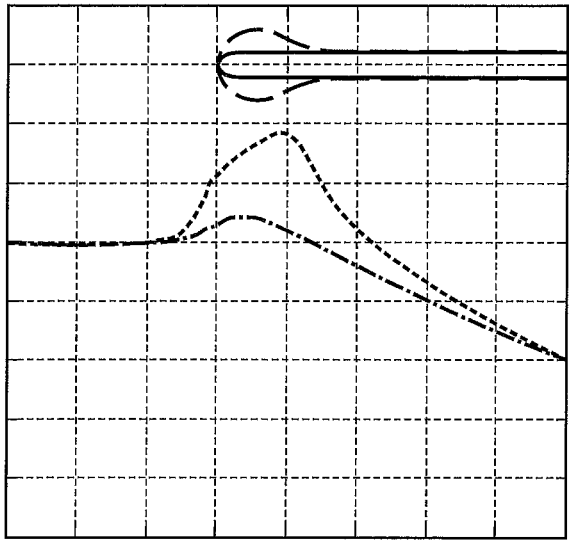
FIG. 3 shows a comparative graph of the velocity in two different impellers.

FIG. 3 shows the gas flow velocity along the flow path both with and without bottleneck; the bottleneck is designed for example so that to cause a sudden/localized increase-decrease in the speed of the gas flowing in the passages of at least 20%; it is worth noting that even without bottleneck there is a slight (e.g. of few percentages) speed increase-decrease and this is due to the leading edge of the blade and its normal nominal thickness. After the inlet zone of the passage, the gas flow velocity continues to gradually decrease at least for a certain portion of the passage. In FIG. 3, the graph relates to the absolute value of the amplitude of the velocity vector.

Figure 4:
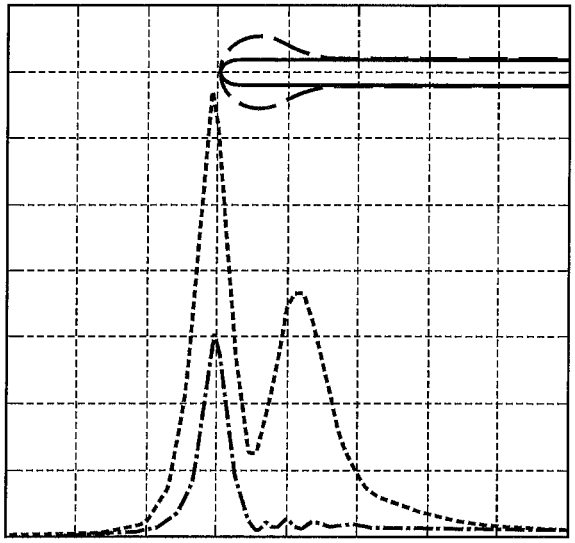
FIG. 4 shows a comparative graph of the acceleration in two different impellers.

FIG. 4 shows the gas flow acceleration along the flow path both with and without bottleneck; the bottleneck is designed for example so that to cause high acceleration (in particular an acceleration peak) and high deceleration (in particular a deceleration peak); it is worth noting that even without bottleneck there is some acceleration increase and this is due to the leading edge of the blade and its normal nominal thickness. In FIG. 4, the graph relates to the absolute value of the amplitude of the acceleration vector and, for this reason, it does not reach the value of zero.

At the light of what has just been described by way of example, it is possible to reduce erosion of an impeller, in particular an impeller of a centrifugal compressor, due to liquid droplets in an incoming flow of gas; a converging-diverging bottleneck is used to first suddenly and substantially increase and then suddenly and substantially decrease the speed of the gas of the incoming gas flow passing through the bottleneck; the bottleneck is localized at an inlet of the impeller; more than one consecutive bottlenecks, equal or different, may be arranged one after the other.

A second measure for reducing the erosion by the droplets is to reduce the component of the speed normal to the surface hit by the droplets; in particular, the surface considered herein is the hub surface as the focus is on centrifugal compressors.

More particularly, the first measure and the second measure can be combined together.

The basic idea is to shape the internal passages of the impeller taking into account the normal acceleration along the gas streamline in the meridional plane.

As the length of the meridional channel increases, the average streamline curvature in the meridional plane decreases and so does the normal acceleration of the gas (i.e. normal to the flow lines in the meridional plane), which, as a matter of fact, is related to the local curvature.

A lower normal acceleration implies that liquid droplets need a lower normal force to follow the flow lines of the gas. Therefore, liquid droplets will deviate less from gas flow lines in the meridional plane. Anyway, deviation cannot be completely avoided, because of the different inertia between gas and liquid.

When liquid droplets deviate less from gas flow lines in the meridional plane, they approach the hub surface of the impeller with a small normal velocity, and this reduces considerably erosion.

Figure 5:
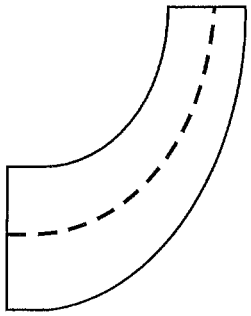
FIG. 5 shows an internal passage of an impeller according to the prior art.
Figure 6:
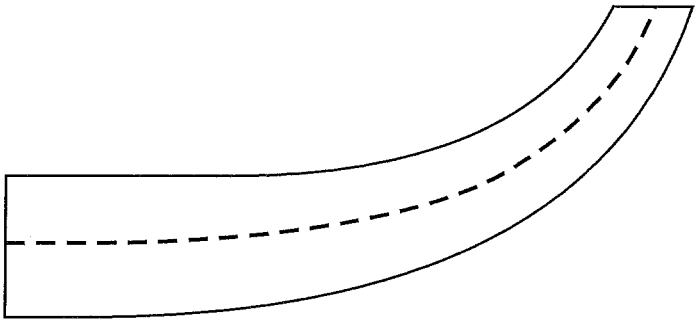
FIG. 6 shows an internal passage of an impeller according to an embodiment.
Figure 7:
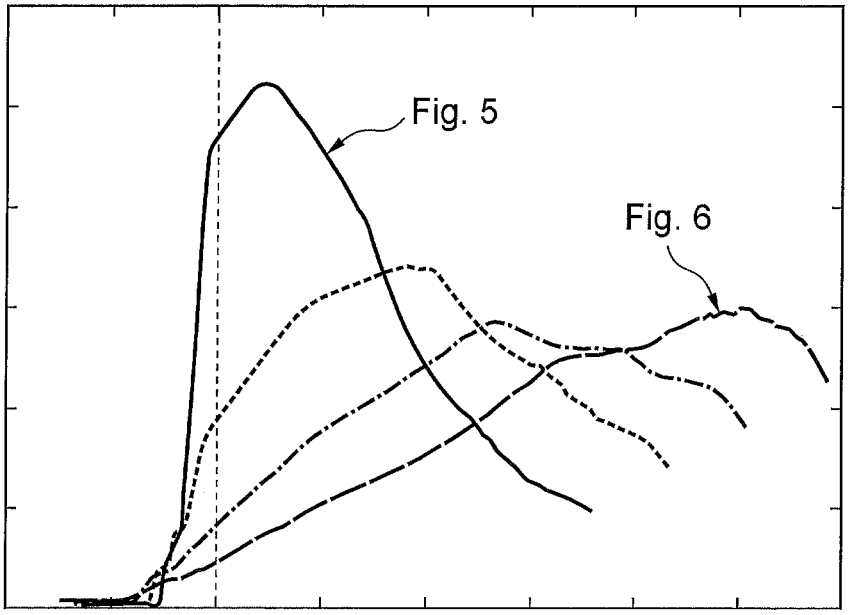
FIG. 7 shows a comparative graph of the normal acceleration in different impellers including the impellers of FIG. 5 and FIG. 6.

FIG. 5 shows an impeller passage in the meridional plane according to the prior art, while FIG. 6 shows an impeller passage in the meridional plane according to an embodiment; it is to be noted that FIG. 6 corresponds to the extreme application of the above mentioned technical teaching. FIG. 7 shows the normal acceleration in the impeller of FIG. 5, in the very long impeller of FIG. 6, and in other two impellers having a two intermediate axial spans; it is clear that, by applying the above mentioned technical teaching, the normal acceleration at each point of the passage improves.

Different parameters may be used for defining the shape of the internal passages of the impeller in the meridional plane in order to provide conditions limiting the values of the normal acceleration, as it will be apparent from the following conditions described with reference to FIG. 8.

At the outlet, the hub contour 801 in the meridional plane may form an angle 803 greater than 10° with radial direction; this is a first way of limiting the overall rotation of the passage.

At the outlet the shroud contour 802 in the meridional plane may form an angle 804 greater than 20° with radial direction; this is a second way of limiting the overall rotation of the passage.

At any point of the hub contour in the meridional plane, the curvature radius 805 of the hub contour is at least 2.5 times the height 806 of the passage measured perpendicularly to the hub contour.

At any point of the shroud contour in the meridional plane, the curvature radius 807 of the shroud contour is at least 1.5 times the height 808 of the passage measured perpendicularly to the shroud contour.

The axial span 810 of the passage in the meridional plane is at least 2 times the height 809 of the passage at the inlet.

Figure 8:
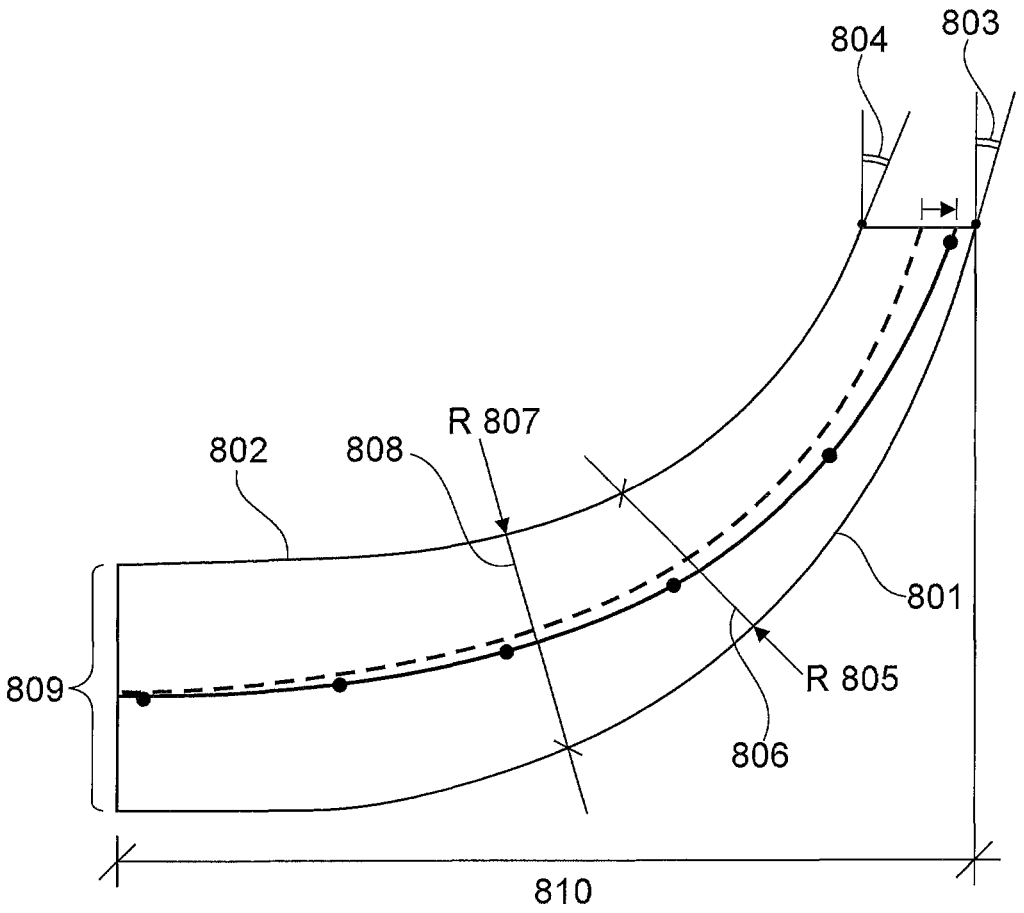
FIG. 8 shows an enlarged view of an internal passage of an impeller according to an embodiment.

The above mentioned conditions, explained with reference to FIG. 8, are based on geometry and may be considered "structural type".

In FIG. 8, a possible trajectory of a liquid droplet inside the internal passage of the impeller is shown; the trajectory of a small volume of gas from a central position of the inlet to the outlet corresponds to a dashed line; it would be desirable that a liquid droplet would follow the same trajectory; anyway, due to normal acceleration, the droplet deviates from the gas trajectory and follows a deviated trajectory (the deviated trajectory corresponds to a continuous line). By reducing the mass and size of the droplet and by using a smoothly curved passage, the deviated trajectory either reaches the hub contour 801 at the end of the passage and a "soft" collision takes place, or does not reach the hub contour 801, as shown in FIG. 8, and no collision takes place.

Other possible conditions are "functional type" and therefore directly based the values of the normal acceleration; these can be better understood with reference to the graph of FIG. 7.

As a first condition, the passages may be shaped so that normal acceleration along gas streamline in the meridional plane does not exceed a predetermined limit.

As a second condition, the passages may be shaped so that the ratio between the maximum value of the normal acceleration inside the impeller and the value of the normal acceleration at the trailing edge of the blades does not exceed e.g. 2.0; it is to be noted that normal acceleration at the leading edge is usually zero or close to zero (see FIG. 7).

One or more of these conditions may be combined together so to better control the normal acceleration in the passages.

At the light of what has just been described by way of example, it is possible to reduce erosion of an impeller, in particular an impeller of a centrifugal compressor, due to liquid droplets in an incoming flow of gas; the incoming flow is deviated (more particularly quite or very) gradually in the meridional plane. As the focus is on centrifugal compressors, the relevant deviations are that on meridional plane; in general, also deviations in the transversal or tangential plane have to be considered.

In order to achieve a gradual deviation, it might be necessary to increase the axial span of the impeller and/or to decrease the bending of the gas flow by the impeller (in a centrifugal compressor the gas flow usually bends by 90°.

A third measure for reducing the erosion by the droplets is to lean the leading edge of the blades with respect to the radial direction; in particular, the lean direction is such as that the shroud profile lags behind the hub profile. In an embodiment, the first measure and the second measure and the third measure can be combined together. More particularly, the lean angle is at least 30°.

Figure 9:
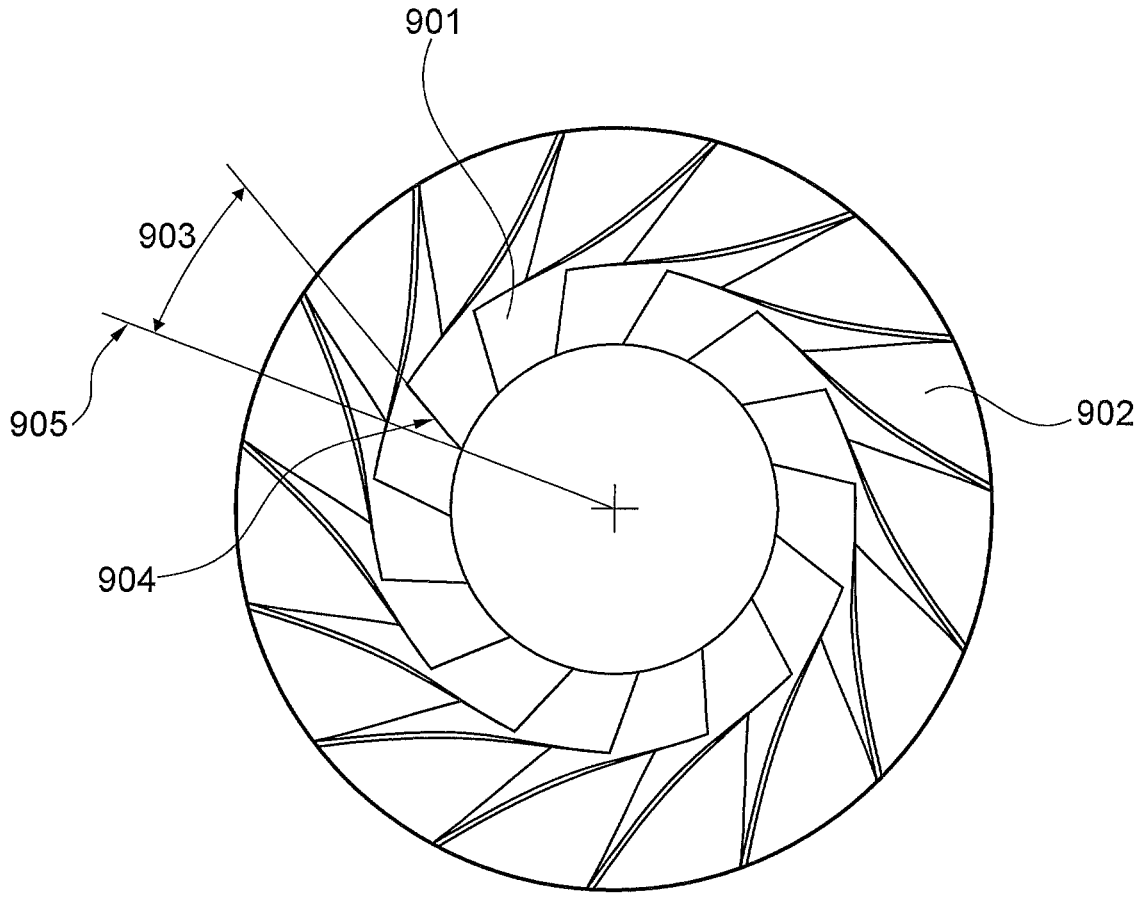
FIG. 9 shows a partial front view of an impeller according to an embodiment.

In FIG. 9, the blades are labeled 901 (one blade is labeled), the hub is labeled 902, the shroud is not shown, the leading edge of the blade is labeled 904, the radial direction is labeled 905 and the lean angle is labeled 903.

Blade leaning at inlet generates a radial pressure gradient, which tends to decrease the mass flow rate near the hub, while it pushes the gas flow towards the shroud; in FIG. 8, the hub contour is labeled 801 and the shroud contour is labeled 802. Therefore, such pressure gradient favors the movement of the liquid droplets according to the shape of the impeller internal passages and thus reduce the erosion of the hub surface.

The above described teachings may be applied to the impellers of centrifugal compressors, for example the centrifugal compressor of FIG. 1; these are particularly useful for the first impeller, i.e. impeller 120 in FIG. 1.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A closed impeller for a rotary machine comprising:
an inlet and an outlet;
a hub having a hub contour;
a shroud having a shroud contour;
a plurality of blades, each blade comprising an upstream portion having a thickness that first increases and then decreases and a downstream portion having a substantially constant thickness; and
a plurality of passages fluidly connecting the inlet to the outlet, each passage defined by the hub, the shroud, and two associated blades of the plurality of blades, and each passage comprising a converging-diverging bottleneck between the respective upstream and downstream portions of the two associated blades that is configured to first increases and then decrease a speed of a gas flowing in the passage, the converging-diverging bottleneck created by the thickness of each of the two associated blades that first increases and then decreases,
wherein at any point along the hub contour in a meridional plane a curvature radius of the hub contour is approximately 2.5 times a height of a respective passage of the plurality of passages measured perpendicularly to the hub contour.

2. The impeller according to claim 1, wherein the thickness decrease immediately follows the thickness increase.

3. The impeller according to claim 1, wherein the thickness decrease ends at a distance from a leading edge of each blade, the distance being more than 2 times and less than 6 times the maximum thickness of each blade.

4. The impeller according to claim 3, wherein the thickness increase starts at the leading edge of each blade.

5. The impeller according to claim 1, wherein a maximum thickness of each the blade is located between 25% and 75% of a length of the increasing and decreasing thickness.

6. The impeller according to claim 1, wherein at the inlet a lean angle of a leading edge of each blade with respect to a radial direction is approximately 30° so that the shroud profile lags behind the hub profile.

7. The impeller according to claim 1, wherein the thickness increase and the thickness decrease are identically distributed on both sides of each blade.

8. A centrifugal compressor having a plurality of compressor stages, the compressor being tolerant to liquid at its inlet, wherein at least the first stage comprises an impeller according to claim 1.

9. A closed impeller for a rotary machine comprising:
an inlet and an outlet;
a hub having a hub contour;
a shroud having a shroud contour;
a plurality of blades, each blade comprising an upstream portion having a thickness that first increases and then decreases and a downstream portion having a substantially constant thickness; and
a plurality of passages fluidly connecting the inlet to the outlet, each passage defined by the hub, the shroud, and two associated blades of the plurality of blades, and each passage comprising a converging-diverging bottleneck between the respective upstream and downstream portions of the two associated blades that is configured to first increases and then decrease a speed of a gas flowing in the passage, the converging-diverging bottleneck created by the thickness of each of the two associated blades that first increases and then decreases,
wherein at any point along the shroud contour in a meridional plane a curvature radius of the shroud contour is approximately 1.5 times a height of a respective passage of the plurality of passages measured perpendicularly to the shroud contour.

10. The impeller according to claim 9, wherein the thickness decrease immediately follows the thickness increase.

11. The impeller according to claim 9, wherein the thickness decrease ends at a distance from a leading edge of each blade, the distance being more than 2 times and less than 6 times the maximum thickness of each blade.

12. The impeller according to claim 11, wherein the thickness increase starts at the leading edge of each blade.

13. The impeller according to claim 9, wherein a maximum thickness of each the blade is located between 25% and 75% of a length of the increasing and decreasing thickness.

14. The impeller according to claim 9, wherein at the inlet a lean angle of a leading edge of each blade with respect to a radial direction is approximately 30° so that the shroud profile lags behind the hub profile.

15. The impeller according to claim 9, wherein the thickness increase and the thickness decrease are identically distributed on both sides of each blade.

16. A centrifugal compressor having a plurality of compressor stages, the compressor being tolerant to liquid at its inlet, wherein at least the first stage comprises an impeller according to claim 9.

* * * * *